United States Patent [19]

Ericson

[11] 3,966,296

[45] June 29, 1976

[54] ANTI-TURN CLIP FOR INCORPORATION IN BOLTED ELECTRICAL JOINTS

[75] Inventor: Eric A. Ericson, Plainville, Conn.

[73] Assignee: General Electric Company, New York, N.Y.

[22] Filed: Jan. 25, 1974.

[21] Appl. No.: 436,696

[52] U.S. Cl. ..... 339/263 R; 151/41.75; 403/22

[51] Int. Cl.[2] ..... H01R 7/08

[58] Field of Search ..... 339/244 R, 9 C, 263 R, 339/263 L, 269, 271; 151/41.75; 24/73 B; 403/13, 21, 22

[56] References Cited

UNITED STATES PATENTS

| | | | |
|---|---|---|---|
| 2,679,634 | 5/1954 | Rawley | 339/263 R X |
| 3,145,753 | 8/1964 | Kreider | 151/41.75 |
| 3,212,046 | 10/1965 | Abel et al. | 339/263 L |
| 3,387,342 | 6/1968 | Seckerson | 151/41.75 X |
| 3,404,366 | 10/1968 | Seckerson | 339/271 X |
| 3,738,406 | 6/1973 | Williams | 151/41.75 |

*Primary Examiner*—Roy Lake
*Assistant Examiner*—Howard N. Goldberg
*Attorney, Agent, or Firm*—Robert A. Cahill; Walter C. Bernkopf; Frank L. Neuhauser

[57] ABSTRACT

An anti-turn clip is formed having an elongated body with a bolt hole adjacent one end accommodating the bolt clamping a bus bar and a line strap in electrical connection. Arms extending laterally from the clip body adjacent the bolt hole straddle the strap and a tab at the other end of the clip body is lodged in a hole in the bus bar, thereby to prevent angular movement of the strap should the bolted joint loosen.

12 Claims, 5 Drawing Figures

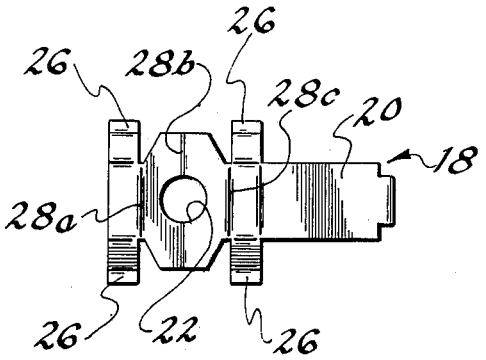
Fig. 2.
Fig. 4.
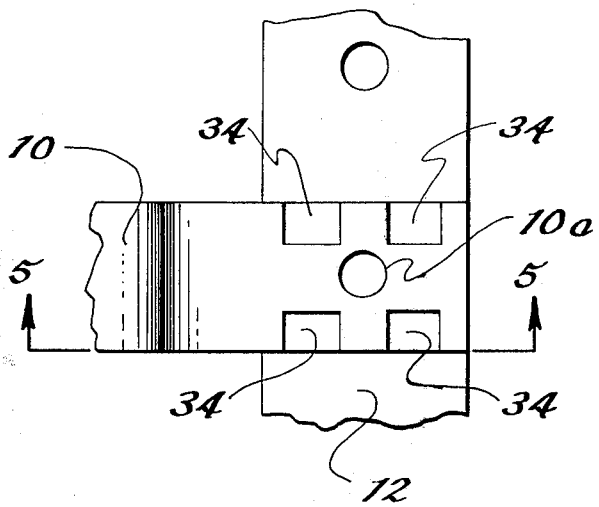
Fig. 5.
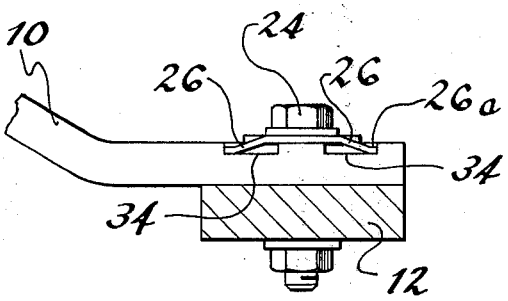

ANTI-TURN CLIP FOR INCORPORATION IN BOLTED ELECTRICAL JOINTS

BACKGROUND OF THE INVENTION

In certain electrical switchboard designs, there is a potential danger, upon removal of a switching device from a live switchboard, that the free ends of the device line straps can swing into contacting engagement with one another to produce a line-to-line fault if the bolted connections of the line straps to the bus bars are not tight. Underwriters Laboratories has recognized this potential hazard and has required that a line strap be restrained from angular movement when the bolt clamping it to the bus bar is only finger tight. To meet this requirement, switchboard manufacturers have proposed to use two bolts in the line strap-bus bar joint. Another proposal is to configure the bus bar and/or the line strap such that they somehow interfit to maintain a fixed angular orientation therebetween despite a loose joint. The former solution requires a large bus bar cross-section which is impractical in smaller switchboards and lighting panels. The latter solution is expensive since it requires a redesign of the cross-section of either or both the bus bar and line strap.

It is accordingly an object of the present invention to provide an electrical joint which maintains the angular orientation of the conjoined parts despite loosening of the joint.

Another object of the present invention is to provide an anti-turn clip for incorporation in a bolted electrical joint, wherein the clip engages the conjoined parts to preserve their angular orientation despite loosening of the bolted joint.

Still another object of the present invention is to provide an anti-turn clip of the above character which is inexpensive to manufacture, easy to install with existing joined parts, and reliable.

Other objects of the invention will in part be obvious and in part appear hereinafter.

SUMMARY OF THE INVENTION

In accordance with the present invention, there is provided an electrical joint, wherein the angular orientation of the joined electrical parts is preserved despite relaxation in the clamping pressure securing the joint. More specifically, the present invention is directed to the provision of an anti-turn clip which is readily incorporated in a bolted electrical joint to prevent turning movement of one of the joined electrical parts relative to the other despite the fact that the bolt securing the joint is not turned tight.

The anti-turn clip of the present invention has particular, but not necessarily limited application to electrical switchboards for maintaining physical separation between line straps by preserving the angular orientation relative to respective vertical bus bars, despite the fact that the bolt securing the line strap-bus bar joint is inadvertently not turned tight or becomes loose. In its preferred form, the anti-turn clip is constructed to have an elongated body which is substantially rigid at least in the direction in which turning or angular movement is to be resisted. A hole is formed adjacent one end of the clip body to accommodate passage therethrough of the bolt used to clamp the strap and bus bar in electrical connection. Arms extend laterally from the clip body adjacent the bolt hole therein to engage opposed lateral surfaces of the strap, while the other end of the clip body is formed having a turned-down tab for engagement in an aperture in the bus bar. As a consequence, the anti-turn clip of the present invention engages the bus bar and line strap at locations spaced from their common pivot point (point of bolted connection) to thus resist any change in the angular orientation of the line strap.

Preferably, the clip is provided with pairs of spaced arms extending from both sides of the clip body to straddle the line strap both fore and aft of the bolted connection. As a consequence, the arms engage the sides of the line strap at diametrically opposed points to resist turning movement of the line strap in either direction about the bolted joint.

To accommodate manufacturing tolerances in the width of the line strap, it is an important feature of the present invention to form a depression in the portion of the clip body surrounding the bolt hole. The arms extend from the clip body beyond the depressed portion thereof. As a consequence, when the bolt passing through the bolt hole in the clip body is tightened down, the depressed portion is plastically deformed into a flattened condition with the result that the spacing between the arms on each side of the clip body is reduced to move the arms into engaging relation with the sides of the line strap regardless of variation in the strap nominal width dimension.

Rather than make various sizes of anti-turn clips, it is proposed in accordance with the present invention to form depressions or recesses in extra wide line straps, wherein the recesses are located such as to receive the clip arms; the innermost recessed walls serving as the opposed surfaces which the arms engage to prevent angular movement of the line strap relative to its associated bus bar.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 2 is a plan view of the anti-turn clip of the present invention;

FIG. 4 is a fragmentary, front elevational view illustrating the modification of a wide line strap in accordance with the present invention so as to accommodate the same sized anti-turn clip shown in FIG. 1; and FIG. 5 is a sectional view taken along line 5—5 of FIG. 4 with the anti-turn clip of the invention incorporated in the joint.

Like reference numerals refer to corresponding parts throughout the several views of the drawings.

DETAILED DESCRIPTION

The present invention has particular application to electrical switchboards wherein line straps 10 are fed from vertical bus bars 12 to supply a branch circuit (not shown) under the control of a switching device, such as a circuit breaker 14. The hazard eliminated by the present invention arises when the circuit breaker is removed while the switchboard is alive and nothing remains at the free ends of the bus bars to prevent the straps from swinging into contact with one another. Should this occur, a short circuit is created with the consequent likelihood for bodily injury and equipment damage. It is thus imperative that the line strap-bus bar joints, generally indicated at 16, be mechanically secure so as to prevent the otherwise unrestrained free ends of the line straps from contacting each other. While a properly maintained joint is sufficiently mechanically secure to maintain separation of the line straps, occasionally these joints will loosen in time or are inadvertently not properly tightened during assembly.

Figure 3:
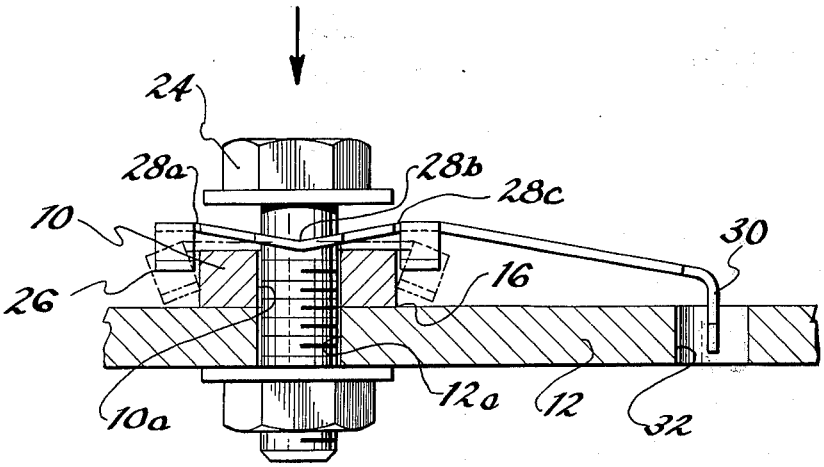
FIG. 3 is a sectional view taken along line 3—3 of FIG. 1.

In accordance with the present invention, an anti-turn clip, generally indicated at 18, is incorporated in each bolted joint between a line strap and a vertical bus bar to prevent the free ends of the line straps from swinging into contact with each other even though one or more of the bolted joints are not mechanically tight. Each anti-turn clip, as seen in FIGS. 2, 3 and 5, is fabricated from a suitable sheet metal stock, such as soft steel, to have an elongated body portion 20 formed with a hole 22 aligned with holes 10*a* and 12*a* in the line strap and bus bar, respectively. The aligned holes accommodate a bolt 24 used to secure the electrical joint 16 (FIG. 3). A pair of spaced arms 26 are formed to extend laterally from each side of the clip body 20. As best seen in FIG. 5, each laterally extending arm 26 is bent downwardly at an angle of approximately 45° away from the plane of the clip body and terminates in a reversely bent free end segment 26*a* lying in a plane substantially parallel to the plane of the clip body.

Referring to FIG. 3, the portion of the clip body surrounding bolt hole 22 is deformed along lateral bend lines 28*a*, 28*b* and 28*c* to provide a shallow V-shaped depression. The intermediate bend line 28*b* laterally bisects the bolt hole 22 while bend lines 28*a* and 28*c* are aligned with the inside edges of the laterally opposed arms 26. The spacing between longitudinally aligned arms 26 is made slightly greater than the nominal width of a line strap 10. As illustrated in phantom in FIG. 3, the spacing between the arms straddling the line strap both fore and aft the bolt hole is decreased as the V-shaped depression is flattened out during tightening of the bolt 24. Thus, by virtue of this unique design feature, the anti-turn clip 18 of the present invention is capable of engaging opposed sides of the line strap both fore and aft of the bolt hole despite minor variations in the width dimension of the strap permitted by manufacturing tolerances. Moreover, by making the anti-turn clip of a plastically deformable metal, such as soft steel, the body depression, once flattened out by the bolt pressure, remains so and the arms 26 maintain their engagement with the line strap despite relaxation of the bolt clamping pressure.

As best seen in FIGS. 2 and 3, the portion of the clip body 20 beyond the arms 26 slopes slightly downwardly and terminates in a turned-down tab 30 which is engaged in a hole 32 formed in bus bar 12. Typically the bus bars 12 are preformed with a series of incrementally spaced holes 32 to facilitate the assembly of switchboards. That is, the holes 32 are preformed in the bus bars at incremental spacings corresponding to the spacing between line terminals on the switching devices 14 to be used in the switchboard. As a consequence, bolt holes 12*a* need not be drilled in the bus bars during switchboard assembly pursuant to making the line strap-bus bar joints 16. By making the length of anti-turn clip 18 between its bolt hole 22 and its turned-down tab 30 equal to its incremental spacing between bolt holes in the bus bar, it is seen that implementation of the anti-turn clip of the present invention requires no modification of the bus bar design.

It is seen that with the turned-down tab lodged in hole 32 of bus bar 12 and the clip arms 26 engaging the sides of line strap 10, these two parts are engaged at locations spaced from their mutual pivot point, i.e., bolt 24, to preserve their angular orientation despite relaxation of the clamping bolt pressure. While the angular orientation to be maintained is a right angle in the illustrated embodiment, it will be appreciated that the anti-turn clip of the present invention can be configured to preserve any desired angular orientation between joined electrical parts.

Figure 1:
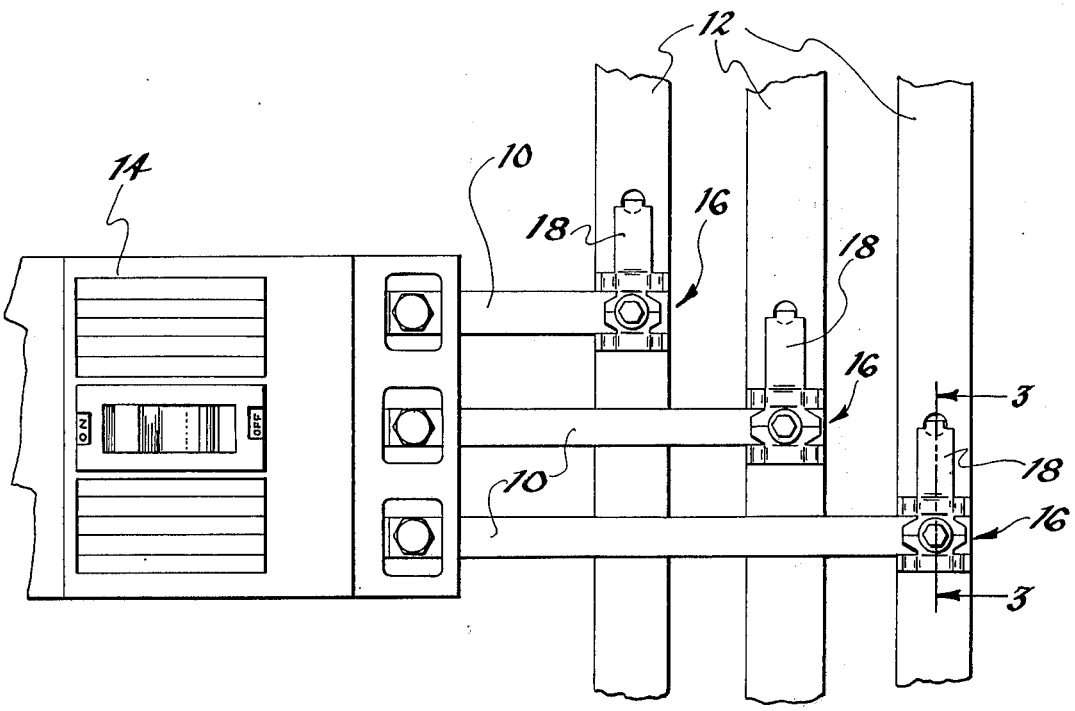
FIG. 1 is a front elevational view of a portion of an electrical switchboard illustrating the incorporation of the anti-turn clips of the present invention in the bolted joints connecting the line straps to respective vertical bus bars.

In the case of higher current rated branch circuits, line straps wider than those shown in FIG. 1 are required. Rather than make various sizes of anti-turn clips so as to accommodate various widths of line straps, such as illustrated in FIGS. 4 and 5, with four rectangular depressions symmetrically arrayed around the bolt hole 10*a* therein. These depressions 34 serve to provide laterally opposed side walls against which the anti-turn clip legs 26 engage pursuant to maintaining its angular orientation relative to the bus bar despite looseness in the bolted joint therebetween.

It will be appreciated that while it is preferred to use four arms 26, it will be seen that just two disposed in either straddling relation to the strap or situated in contiguous relation to one lateral edge of the strap fore and aft of the bolt hole, would be effective in providing the anti-turn capability. The anti-turn function may be also achieved by having the arms closely straddle the bus bar and the tab engaged in a hole formed in the line strap. It will be observed from FIGS. 3 and 5 that the thickness of the line strap has no effect on the anti-turn functioning of the clip 18.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. An electrical joint comprising, in combination:

A. a rigid first current carrying member of rectangular cross-section having a bolt hole formed therein;

B. a rigid second current carrying member of rectangular cross-section having a bolt hole formed therein;

C. a bolt projecting through said bolt holes for clamping said members in electrical connection; and D. an anti-turn clip secured to said electrical joint by said bolt, said clip having 1. an elongated body, 2. first means forming an aperture in said body adjacent one end thereof accommodating said bolt, 3. second means carried by said body adjacent said aperture and disposed in engaging relation with said first member, and
4. third means carried by said body at the other end thereof remote from said aperture and disposed in engaging relation with said second conductive member, the angular relationship of said second and third means preserved by said body,
5. whereby to preserve the angular orientation of said members despite relaxation in the clamping pressure exerted by said bolt.

2. The joint defined in claim 1, wherein said second means includes a pair of spaced arms extending laterally from said body adjacent said aperture, said arms disposed in contiguous relation to lateral surface portions of said first member.

3. The joint defined in claim 2, wherein said third means is in the form of a turned down tab accommodated in an aperture formed in said second member.

4. The joint defined in claim 2, wherein said arms have free ends and said first member includes means forming recesses in a surface thereof to accommodate the free ends of said arms, said lateral surface portions being provided by walls of said recesses.

5. The joint defined in claim 4, wherein said clip body is fabricated of plastically deformable metal sheet stock.

6. The joint defined in claim 2, wherein said arms are disposed in contiguous relation to opposed lateral surface portions of said first member, and the portion of said body surrounding said aperture is deformed into a depression such that, when said clip is incorporated in an electrical joint, the bolt clamping pressure acts to flatten out said deformed body portion and thereby reduce the spacing between said arms so as to bring said arms into engaging relation with said opposed lateral surface portions.

7. The joint defined in claim 6, wherein said depression is formed along lateral bend lines into a shallow V-shaped depression, said arms extending from one side of said body in flanking relation to said depression.

8. The joint defined in claim 1, wherein said second means includes a pair of spaced arms extending laterally from each side of said body to straddle said first member at two locations along the length thereof.

9. The joint defined in claim 8, wherein two of said arms are laterally aligned on one side of said body aperture and the other two of said arms are laterally aligned on the other side of said body aperture.

10. For use with a bolted electrical joint between rigid first and second current carrying members having rectangular cross-sections, a clip for maintaining a predetermined angular relationship between the members despite looseness of the bolt securing the joint, said clip comprising:

A. an elongated body;
B. means forming an aperture in said body adjacent one end thereof to accommodate passage of the bolt used to make the bolted joint;
C. a pair of spaced arms extending laterally from said body adjacent said aperture, said arms adapted for disposal in contiguous relation to opposed lateral surface portions of the first member;
D. means deforming the portion of said body surrounding said aperture into a depression such that, when said clip is incorporated in an electrical joint, the bolt clamping pressure acts to flatten out said deformed body portion and thereby reduce the spacing between said arms so as to bring said arms into engaging relation with the opposed lateral surface portions of the first member; and
E. means carried by said body at the other end thereof for engaging the second member.

11. The clip defined in clam 10, wherein said depression is formed along lateral bend lines into a shallow V-shaped depression, said arms extending from one side of said body in flanking relation to said depression.

12. The clip defined in claim 11, wherein said clip body is fabricated of plastically deformable metal sheet stock.

* * * * *